US007887297B2

(12) United States Patent
Allen-Bradley et al.

(10) Patent No.: US 7,887,297 B2
(45) Date of Patent: Feb. 15, 2011

(54) AIRFOIL ARRAY WITH AN ENDWALL PROTRUSION AND COMPONENTS OF THE ARRAY

(75) Inventors: Eunice Allen-Bradley, East Hartford, CT (US); Eric A. Grover, Tolland, CT (US); Thomas J. Praisner, Colchester, CT (US); Joel H. Wagner, Wethersfield, CT (US)

(73) Assignee: United Technologies Corporation, Hartford, CT (US)

( * ) Notice: Subject to any disclaimer, the term of this patent is extended or adjusted under 35 U.S.C. 154(b) by 543 days.

(21) Appl. No.: 11/415,915

(22) Filed: May 2, 2006

(65) Prior Publication Data

US 2007/0258819 A1 Nov. 8, 2007

(51) Int. Cl.
*F01D 5/22* (2006.01)

(52) U.S. Cl. ..... 416/193 A

(58) Field of Classification Search ..... 415/191, 415/208.2, 211.2; 416/193 A, 223 R, 228, 416/243

See application file for complete search history.

(56) References Cited

U.S. PATENT DOCUMENTS 2,735,612 A * 2/1956 Hausmann ..... 415/208.1
2,918,254 A * 12/1959 Hausammann ..... 415/116
3,890,062 A * 6/1975 Hendrix et al. ..... 416/234
4,194,869 A * 3/1980 Corcokios ..... 415/209.4
4,465,433 A * 8/1984 Bischoff ..... 416/223 A
6,190,128 B1 2/2001 Fukuno et al.
6,283,713 B1 9/2001 Harvey et al.
6,419,446 B1 7/2002 Kvasnak et al.
6,478,539 B1 11/2002 Trutschel
6,561,761 B1 * 5/2003 Decker et al. ..... 415/173.1
6,669,445 B2 * 12/2003 Staubach et al. ..... 416/193 A
6,969,232 B2 * 11/2005 Zess et al. ..... 415/191
2006/0127220 A1 6/2006 Lee
2006/0140768 A1 6/2006 Tam et al.
2006/0153681 A1 7/2006 Lee et al.

OTHER PUBLICATIONS

Sauer et al (2000), "Reduction of Secondary Flow Losses in Turbine Cascades by Leading Edge Modifications at the Endwall", *ASME* 2000-GT-0473, pp. 1-10.

Morris et al (1975), "Secondary Loss Measurements in a Cascade of Turbine Blades with Meridional Wall Profiling", *ASME* 75-WA/GT-30.

Atkins (1987), "Secondary Losses and End-Wall Profiling in a Turbine Cascade" *I Mech. E* C255/87, pp. 29-42.

* cited by examiner

*Primary Examiner*—Edward Look
*Assistant Examiner*—Sean J Younger
(74) *Attorney, Agent, or Firm*—Carlson, Gaskey & Olds, PC

(57) ABSTRACT

An airfoil array includes a laterally extending endwall 56 with a series of airfoils such as 28, or 38 projecting from the endwall. The airfoils cooperate with the endwall to define a series of fluid flow passages 74. The endwall has a hump 84 toward a pressure side of the passage and a less elevated profile toward a suction side of the passage for reducing secondary flow losses.

30 Claims, 13 Drawing Sheets

AIRFOIL ARRAY WITH AN ENDWALL PROTRUSION AND COMPONENTS OF THE ARRAY

CROSS REFERENCE TO RELATED APPLICATIONS

This application includes subject matter in common with co-pending applications entitled "Airfoil Array with an Endwall Depression and Components of the Array", Ser. No. 11/415,915 and "Blade or Vane with a Laterally Enlarged Base", Ser. No. 11/415,892, both filed concurrently herewith, all three applications being assigned to or under obligation of assignment to United Technologies Corporation.

TECHNICAL FIELD

This invention relates to airfoil arrays such as those used in turbine engines and particularly to an airfoil array having a nonaxisymmetric endwall for reducing secondary flow losses.

BACKGROUND

A typical gas turbine engine includes a turbine module with one or more turbines for extracting energy from a stream of working medium fluid. Each turbine has a hub capable of rotation about an engine axis. The hub includes peripheral slots for holding one or more arrays (i.e. rows) of blades. Each blade includes an attachment adapted to fit in one of the slots, a platform and an airfoil. When the blades are installed in the hub the platforms cooperate with each other to partially define the radially inner boundary of an annular working medium flowpath. The airfoils span across the flowpath so that the airfoil tips are in close proximity to a nonrotatable casing. The casing circumscribes the blade array to partially define the radially outer boundary of the flowpath. Alternatively, a blade may have a radially outer platform or shroud that partially defines the radially outer boundary of the flowpath. The radially inner platform and the radially outer platform (if present) partially define flowpath endwalls.

A typical turbine module also includes one or more arrays of vanes that are nonrotatable about the engine axis. Each vane has radially inner and outer platforms that partially define the radially inner and outer flowpath boundaries. An airfoil spans across the flowpath from the inner platform to the outer platform. The vane platforms partially define the flowpath endwalls.

During engine operation, a stream of working medium fluid flows through the turbine flowpath. Near the endwalls, the fluid flow is dominated by a vortical flow structure known as a horseshoe vortex. The vortex forms as a result of the endwall boundary layer which separates from the endwall as the fluid approaches the leading edges of the airfoils. The separated fluid reorganizes into the horseshoe vortex. There is a high loss of efficiency associated with the vortex. The loss is referred to as "secondary" or "endwall" loss. As much as 30% of the loss in a row of airfoils can be attributed to endwall loss. Further description of the horseshoe vortex, the associated fluid dynamic phenomena and geometries for reducing endwall losses can be found in U.S. Pat. No. 6,283,713 entitled "Bladed Ducting for Turbomachinery" and in Sauer et al., "Reduction of Secondary Flow Losses in Turbine Cascades by Leading Edge Modifications at the Endwall", ASME 2000-GT-0473.

Notwithstanding the presumed merits of the geometries disclosed in the above references, other ways of mitigating secondary flow losses are sought.

SUMMARY

One embodiment of the airfoil array described herein includes a laterally extending endwall with a series of airfoils projecting from the endwall. The airfoils cooperate with the endwall to define a series of fluid flow passages. The endwall has a hump toward a pressure side of the passage and a less elevated profile toward a suction side of the passage.

The foregoing and other features of the various embodiments of the airfoil array will become more apparent from the following detailed description and the accompanying drawings.

DETAILED DESCRIPTION

Figure 1:
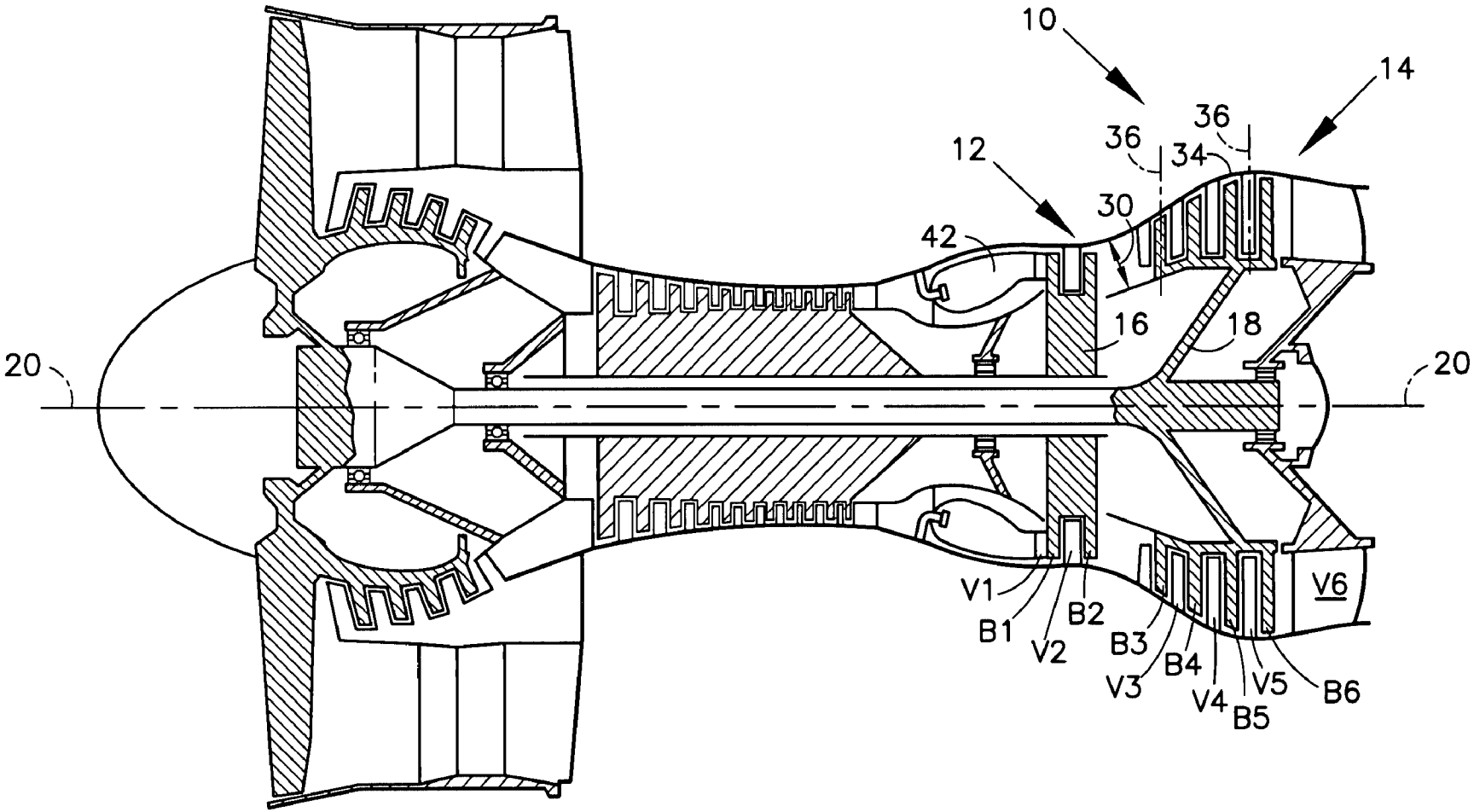
FIG. 1 is a schematic, side elevation view of a turbofan gas turbine engine.
Figure 2:
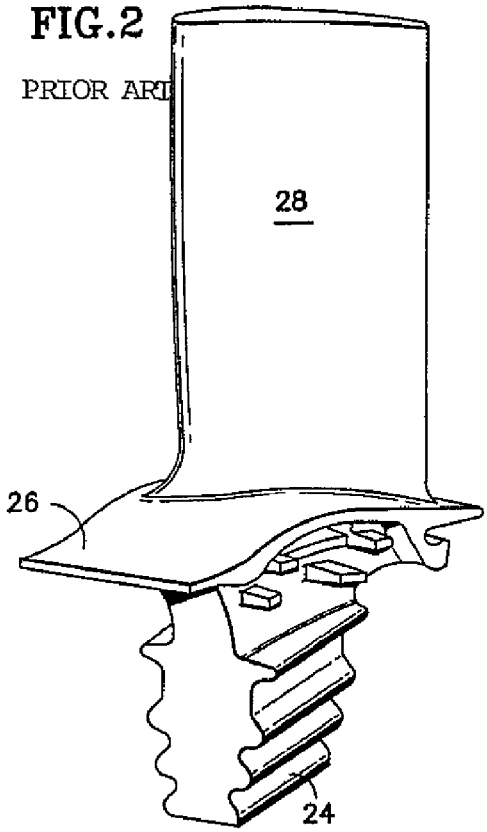
FIG.2 PRIOR ART
FIG. 2 is a view of a typical turbine engine blade having a single platform.
Figure 3:
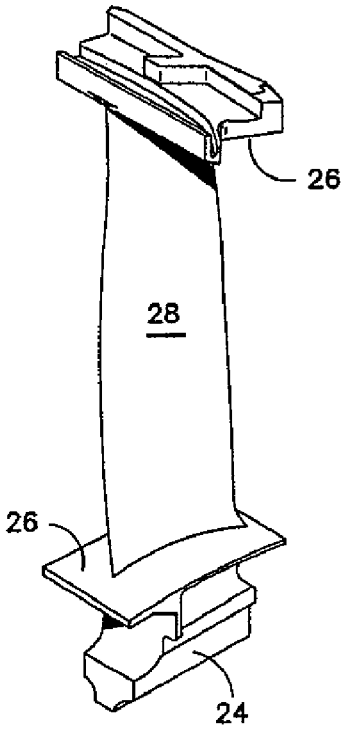
FIG.3 PRIOR ART
FIG. 3 is a view of a typical turbine engine blade having two platforms.

FIG. 1 shows a gas turbine engine whose components include a turbine module 10 comprising a high pressure turbine 12 and a low pressure turbine 14. Each turbine includes a respective hub 16, 18 capable of rotation about a longitudinally extending rotational axis 20. The hubs include peripheral slots, not shown, for holding one or more arrays (i.e. rows) of blades such as blades B1 through B6. As seen in FIG. 2, a typical blade includes an attachment 24 adapted to fit in one of the hub slots, a platform 26 and an airfoil 28. When the blades are installed in the hub, the platforms cooperate with each other to partially define the radially inner boundary of an annular working medium flowpath 30. The airfoils span across the flowpath so that the airfoil tips are in close proximity to a nonrotatable casing 34. The casing circumscribes the blade array to partially define the radially outer boundary of the flowpath. Alternatively, as seen in FIG. 3, a blade may also have a radially outer platform 26 or shroud that partially defines the radially outer boundary of the flowpath. The radially inner platform and the radially outer platform (if present) partially define a flowpath endwall or endwalls. As used herein, "endwall" refers to a flowpath boundary relative to which the airfoils do not rotate about axis 20, although the airfoil may be pivotable about a pivot axis 36 in order to vary the airfoil angle of attack.

Figure 4:
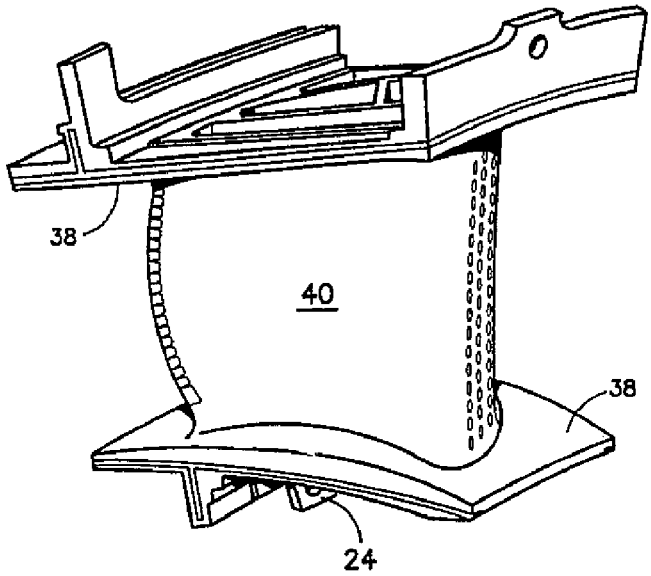
FIG.4 PRIOR ART
FIG. 4 is a view of a typical turbine engine vane.

A typical turbine also includes one or more arrays of vanes, such as vanes V1 through V6 that are nonrotatable about the engine axis 20. As seen in FIG. 4, each vane has radially inner and outer platforms 38 that partially define the radially inner and outer flowpath boundaries. An airfoil 40 spans across the flowpath from the inner platform to the outer platform. The vane platforms partially define flowpath endwalls. The airfoils of the vanes, like those of the blades, may be pivotable about a pivot axis 36.

As seen in FIG. 1, the high pressure turbine includes a row of first stage vanes V1 directly exposed to a stream of gaseous combustion products discharged from combustor 42. Because the first stage airfoils are directly exposed to the gases discharged from the combustor, they may be referred to as nonembedded airfoils. The second and subsequent stage vanes, V2 through V6, as well as all the stages of turbine blades, B1 through B6, are aft of the first stage vanes, and so their airfoils may be referred to as embedded airfoils.

Figure 5:
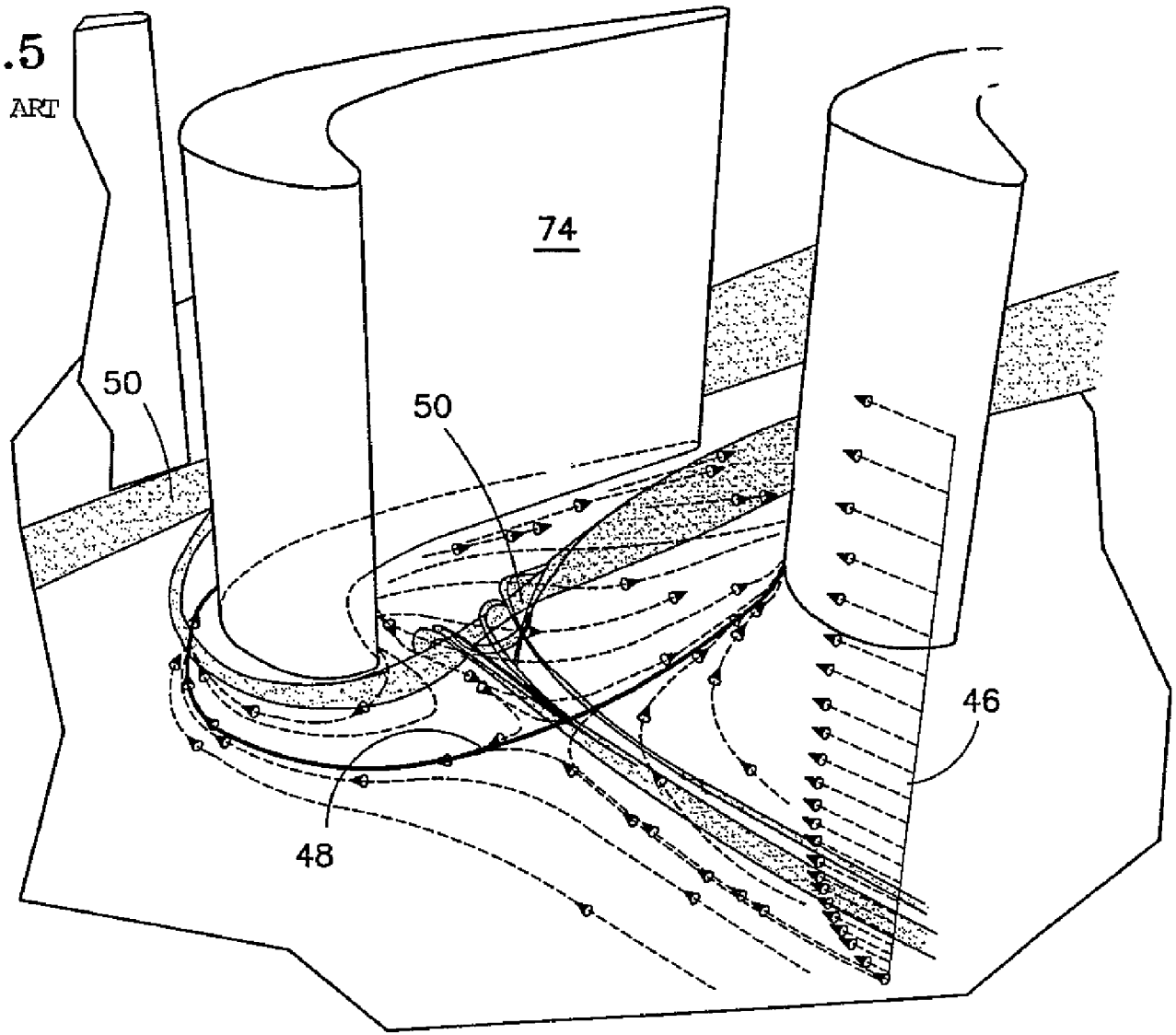
FIG.5 PRIOR ART
FIG. 5 is a perspective view showing a portion of an airfoil array with an axisymmetric endwall and also illustrating a horseshoe vortex and related aerodynamic features.

Referring to FIG. 5, during engine operation, a stream of working medium fluid, i.e. the combustion gases, flows through the turbine flowpath. Near the endwalls, which are axisymmetric in conventional airfoil arrays, the boundary layer 46 of the fluid stream separates from the endwall along a separation line 48. The separated fluid reorganizes into a horseshoe vortex 50 which grows in scale as it extends along the passage between the airfoils. The enlargement of the vortex exacerbates the loss of efficiency.

Figure 6:
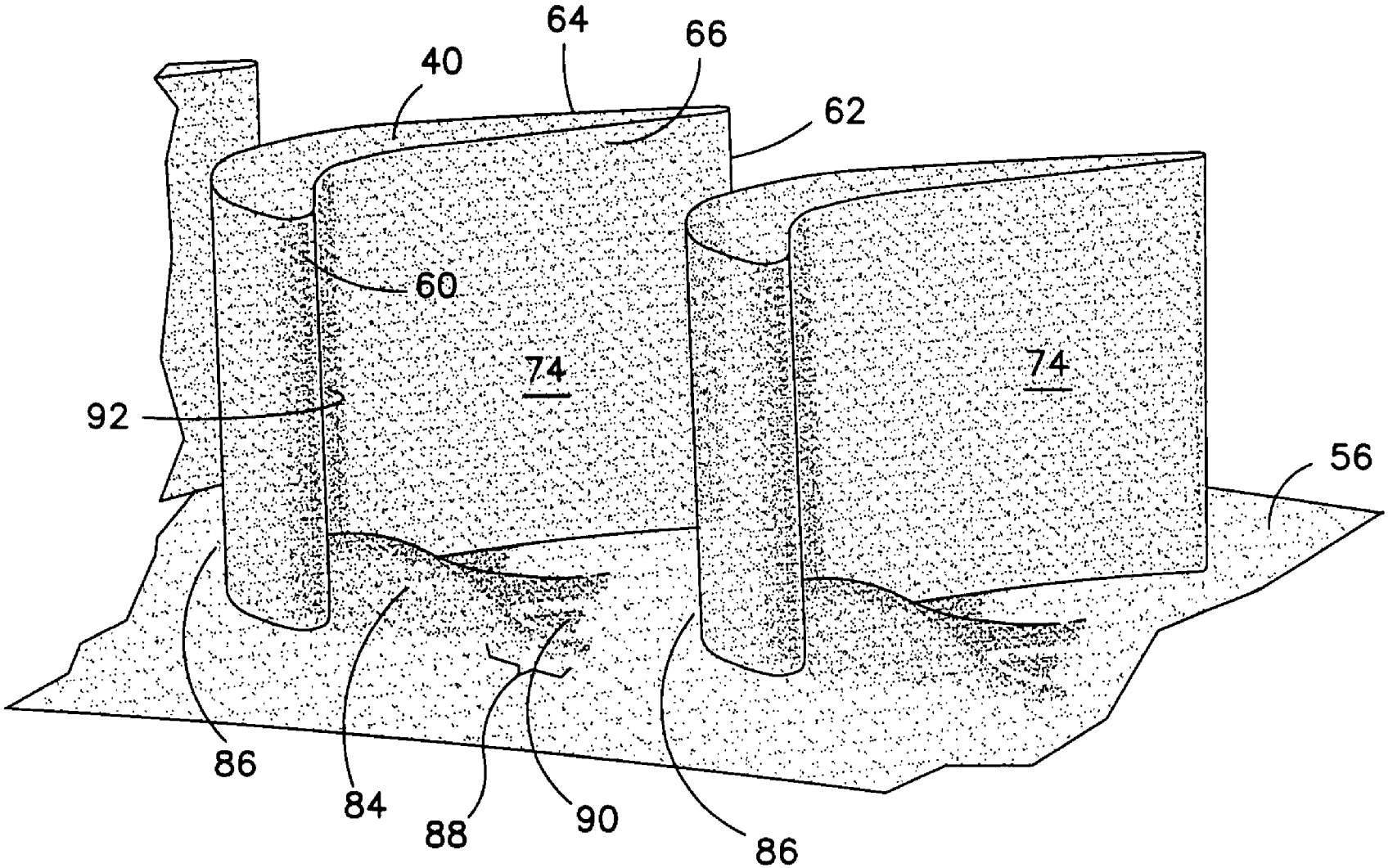
FIG. 6 is a perspective view and FIG. 6A is a plan view with topographic contours showing a portion of an airfoil array with a protrusion or hump on the endwall.
Figure 6A:
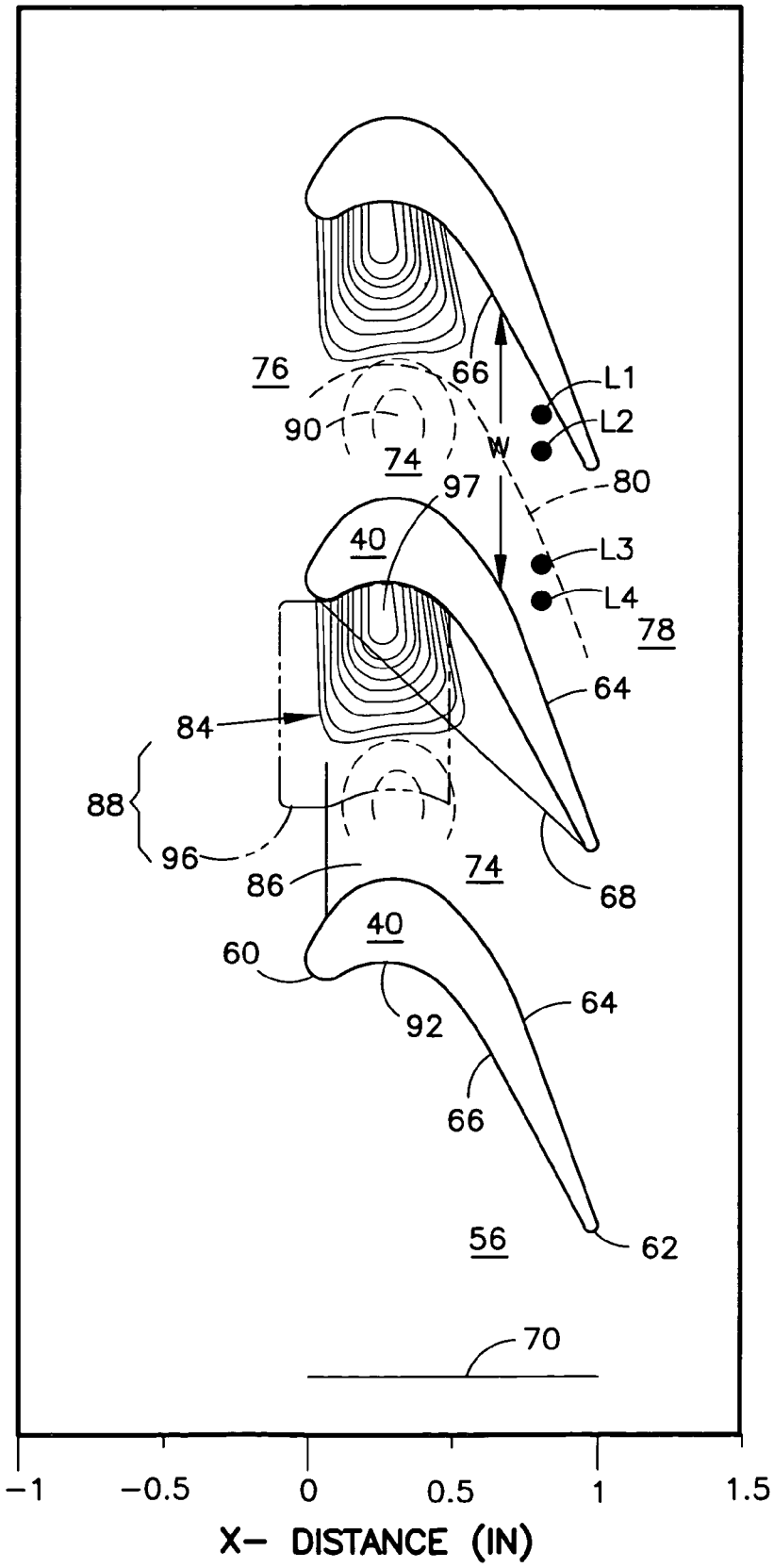

FIGS. 6 and 6A show a portion of an airfoil array. The array includes a laterally (i.e. circumferentially) extending endwall 56 with a series of airfoils, such as vane airfoil 40, projecting radially from the endwall. Each airfoil has a leading edge 60, a trailing edge 62, a suction surface 64 and a pressure surface 66. Each airfoil also has a chord 68, which is a line from the leading edge to the trailing edge, and an axial chord 70, which is a projection of the chord 68 onto a plane containing the engine axis 20 (FIG. 1). Relevant distances may be expressed as a fraction or percentage of the axial chord length as seen in the fractional scale at the bottom of FIG. 6A. This distance scale may be extended to negative values to refer to locations forward of the airfoil leading edge and to values greater than 1.0 (100%) to refer to locations aft of the trailing edge. The airfoils cooperate with the endwall to define a series of fluid flow passages 74 each having passage width W that typically varies from passage inlet 76 to passage outlet 78 so that the passage width may be locally different at different chordwise locations. The passage may also be considered to have a width for a short distance forward of the inlet and aft of the outlet. Forward of the passage inlet 76, the passage width is considered to be equal to the passage width at the inlet. Aft of the passage outlet 78, the passage width is considered to be equal to the passage width at the outlet. A meanline 80 extends along each passage laterally midway between each airfoil pressure surface and the suction surface of the neighboring airfoil. Each passage also has a pressure side and a suction side. The phrases "pressure side" and "suction side" as used herein are relative terms. For example, as seen in FIG. 6A, location L2 is at a suction side location in the passage relative to L1, even though L2 is laterally closer to an airfoil pressure surface than it is to an airfoil suction surface. Similarly, location L3 is at a pressure side location in the passage relative to L4, even though L3 is laterally closer to an airfoil suction surface than it is to an airfoil pressure surface.

The endwall has a pressure side protrusion or hump 84. With increasing lateral displacement toward the suction side the hump blends into a less elevated endwall profile 86. the less elevated profile is preferably axisymmetric or it may include a minor depression 90 as depicted in FIG. 6A. However the depression, if present, is not complementary to the hump. That is, the magnitude of the depression does not balance the magnitude of the hump such that the increase in passage cross sectional area attributable to the depression equals the decrease in cross sectional area attributable to the hump. As can be appreciated, the hump has at least a portion extending from the airfoil having a concave downward profile, or following a concave function.

The particular endwall profile of FIGS. 6 and 6A has a hump 84 near the airfoil pressure surface just aft of the leading edge and nestled in a cove region 92 of the airfoil. The cove is that portion of the airfoil where the curvature or camber of the pressure surface is most pronounced. The hump may extend laterally and axially further than the illustrated hump. The hump has a peak 97 residing within the footprint 96 whose axial range is from about−10% to about 50% of the axial chord and whose lateral range is from about the pressure surface 66 to about 60% of the local passage width W. While the axial range may be from −10% of the axial chord, as is illustrated, the entire hump is within the axial chord in the illustrated embodiment. The hump may also have one or more sub-peaks (not depicted in the example hump) whose radial heights are less than that of the peak 97 so that the hump is comprised of multiple constituent protuberances. The peak need not be at or near the center of the footprint 96. The radial height of the peak is between about 3% and about 20% of the length of the axial chord. In addition, the peak need not be localized as shown but may be spatially distributed in the form of a ridge. The exact topography and range of the hump is best determined by testing and/or analysis.

The hump 84 is believed to be most beneficial for embedded airfoils such as those used in second and subsequent stage vane arrays and in first and subsequent blade arrays arrays.

In an airfoil array with a conventional axisymmetric endwall (FIG. 5) working medium fluid that impinges on the pressure surfaces migrates radially along the pressure surfaces toward the endwall. The migrated fluid then becomes entrained in the horseshoe vortex 50, causing the vortex to grow in scale as it extends along the passage 74 between the airfoils. The enlargement of the vortex exacerbates the loss of efficiency. By contrast, the hump 84 in the endwall of FIGS. 6 and 6A locally accelerates a portion of the boundary layer. The local acceleration helps the fluid to hug the pressure surfaces of the airfoils rather than becoming entrained in the horseshoe vortex 50.

Figure 7:
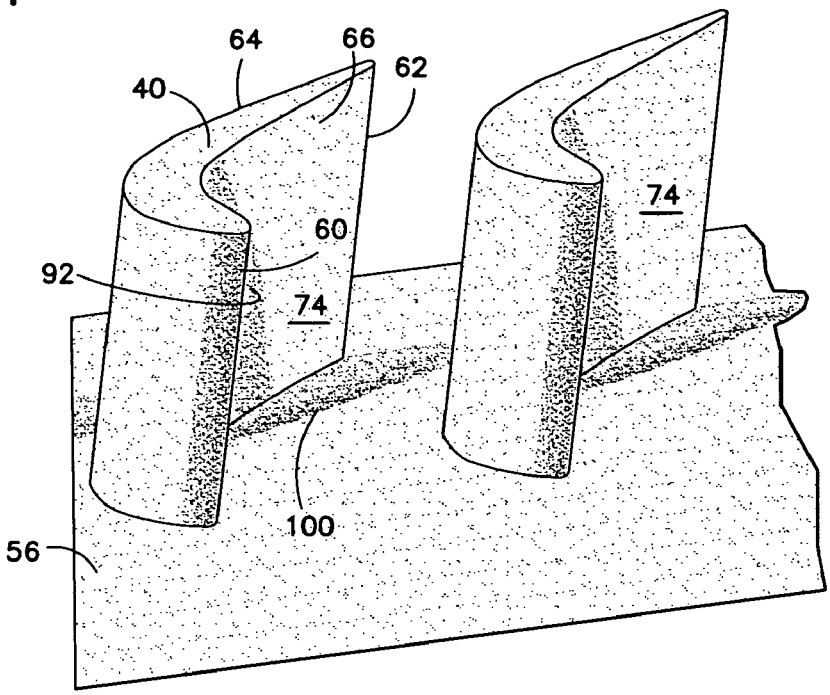
FIG. 7 is a perspective view and FIGS. 7A and 7B are plan views with topographic contours showing a portion of an airfoil array with a depression or trough on the endwall with FIG. 7B also showing a bulge on the endwall.
Figure 7A:
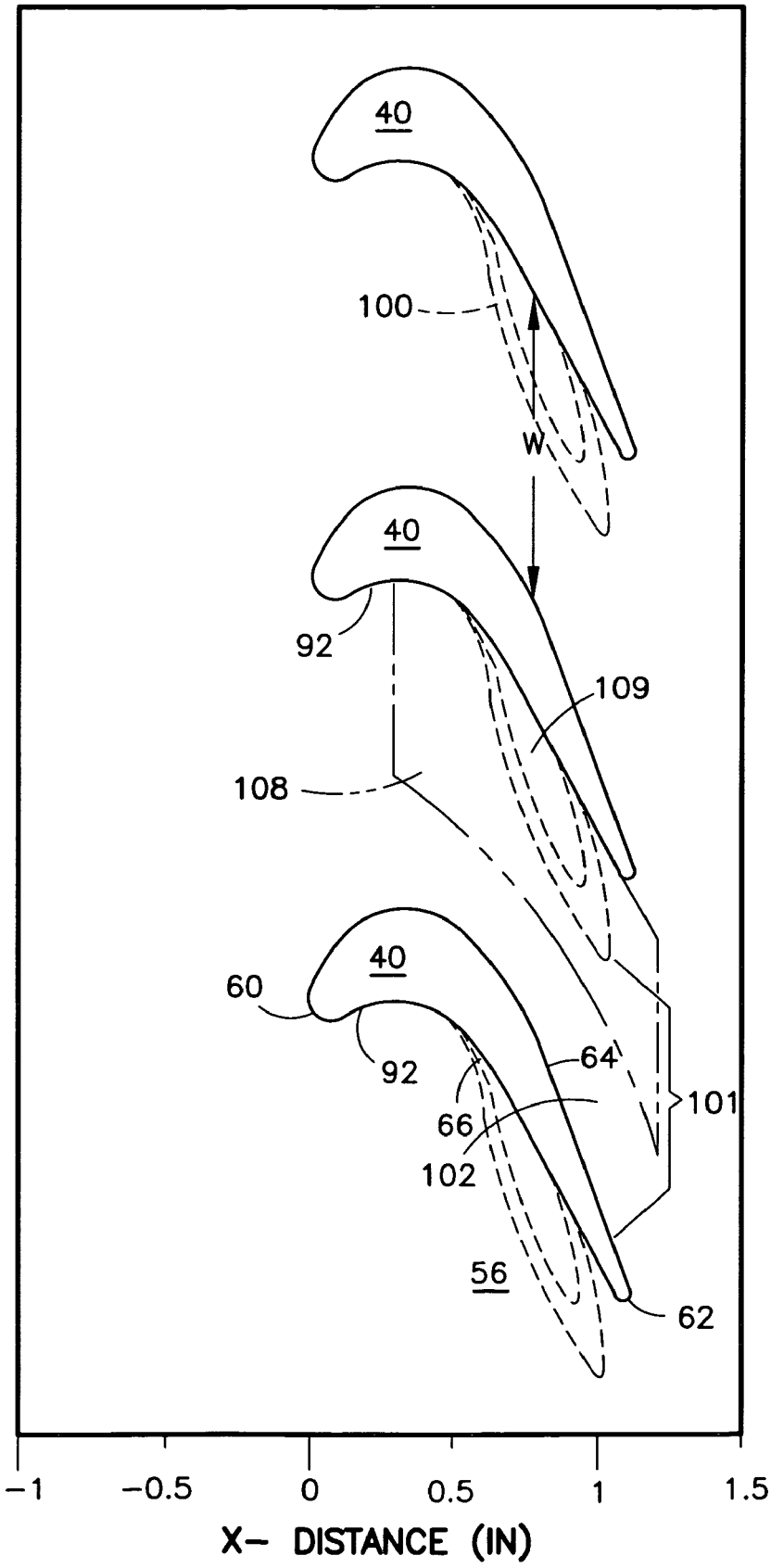
Figure 7B:
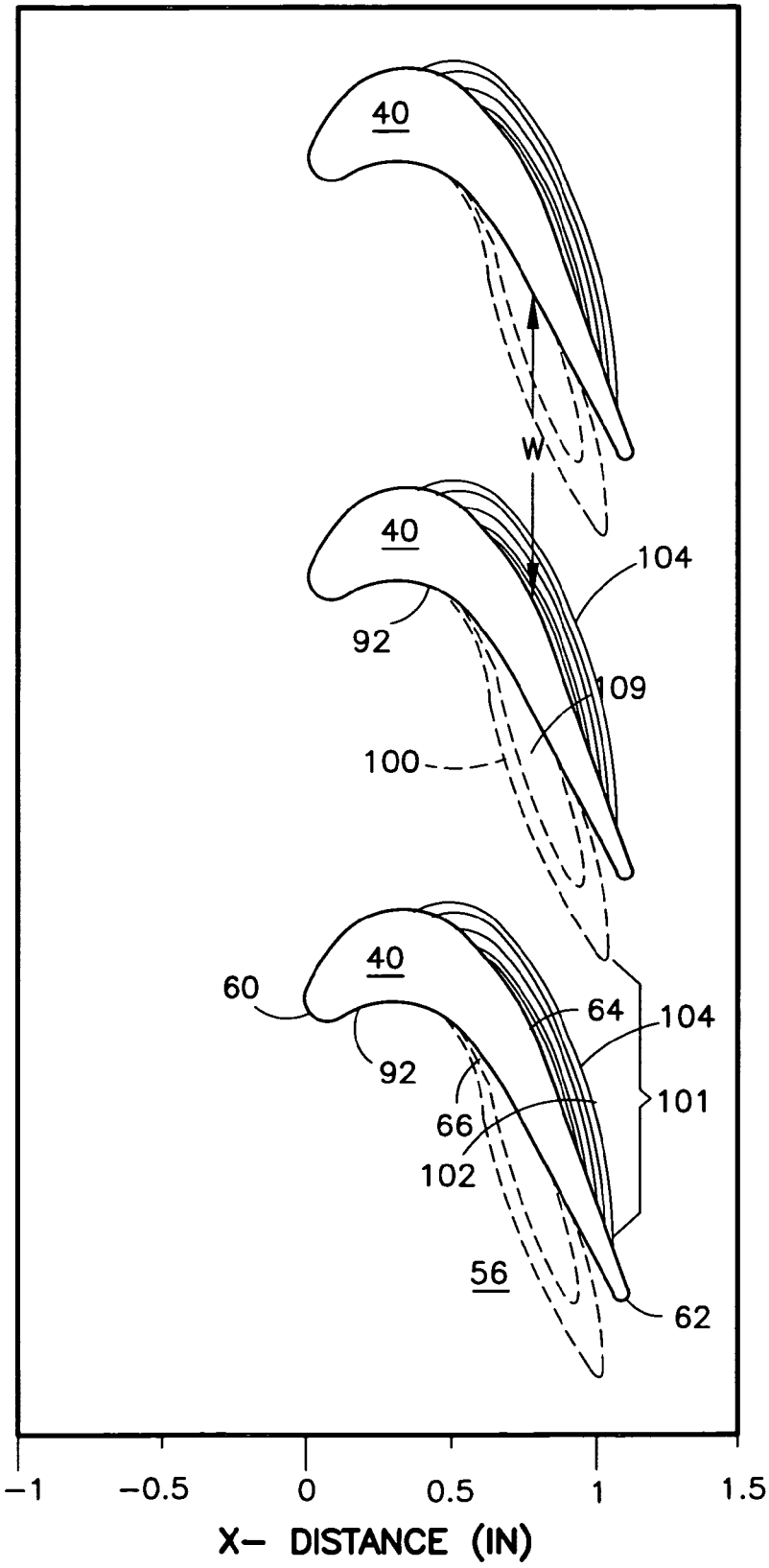

FIGS. 7, 7A and 7B show a portion of another airfoil array. The endwall 56 has a pressure side depression or trough 100. With increasing lateral displacement toward the suction side, the trough blends into a region 101 that is elevated relative to the trough. The elevated region is preferably axisymmetric but it may include a bulge 104 as depicted in FIG. 7B. However the bulge, if present, is not complementary to the trough.

That is, the magnitude of the bulge does not balance the magnitude of the trough such that the decrease in passage cross sectional area attributable to the bulge equals the increase in cross sectional area attributable to the trough.

The particular endwall profile of FIGS. 7 through 7B has a trough 100 mostly aft of the cove 92 of the airfoil. The hump may extend laterally and axially further than the illustrated hump. The trough has a negative peak 109 residing within a footprint 108 whose axial range is from about 30% to about 120% of the axial chord and whose lateral range is from about the pressure surface 66 to about 60% of the local passage width W. The negative peak need not be at or near the center of the footprint 108. The maximum radial depth of the negative peak is between about 3% and about 20% of the length of the axial chord. The negative peak may be spatially extended, as shown, or may be more localized. The bulge 104, if present, has a maximum height relative to an axisymmetric profile that is smaller than the maximum depth of the trough 100. The exact topography and range of the trough and bulge (if present) are best determined by testing and/or analysis.

The trough 100 is believed to be most beneficial for non-embedded airfoils such as those used in first stage vane arrays.

During engine operation, the trough guides the horseshoe vortex along the pressure side of the passage, which reduces the losses associated with the vortex.

Figure 8:
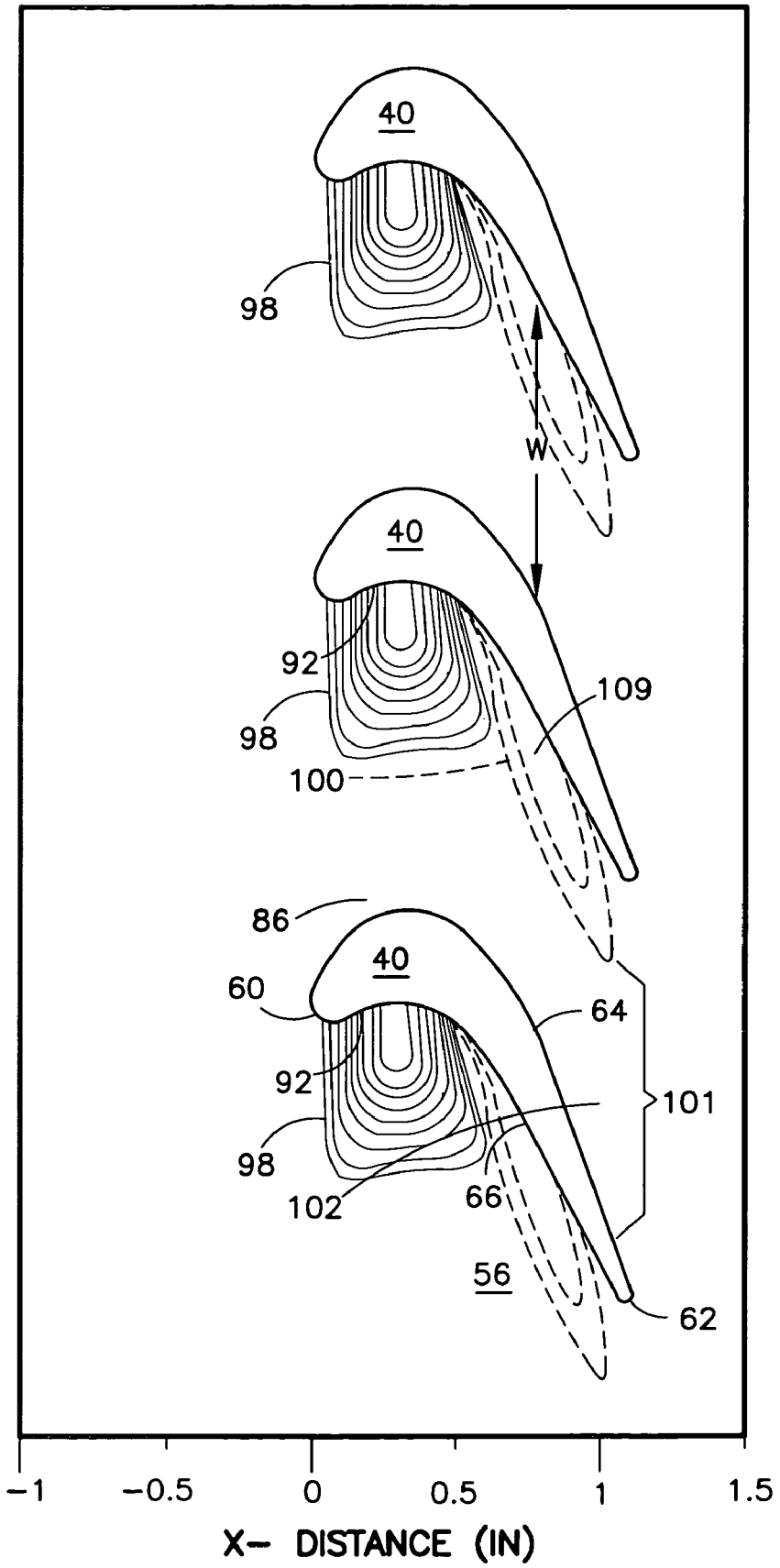
FIG. 8 is a plan view with topographic contours showing an airfoil array with a hump and trough used in combination on an endwall.

Referring to FIG. 8, the hump 84 and trough 100 may be used together with the trough residing essentially aft of the hump.

Figure 9:
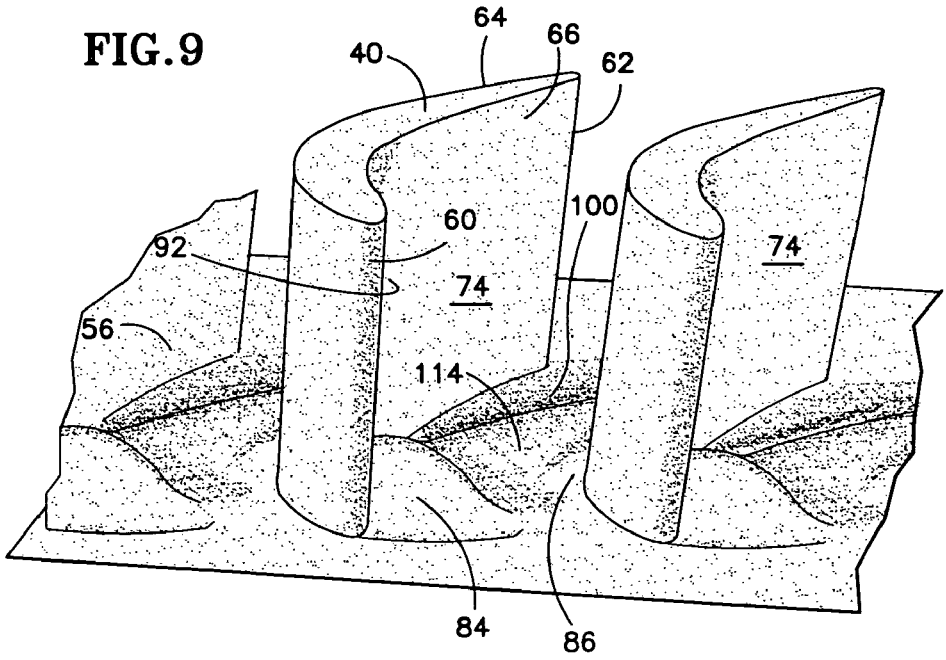
FIG. 9 is a perspective view and FIG. 9A is a plan view with topographic contours showing a portion of an airfoil array with a variety of nonaxisymmetric features used in combination.
Figure 9A:
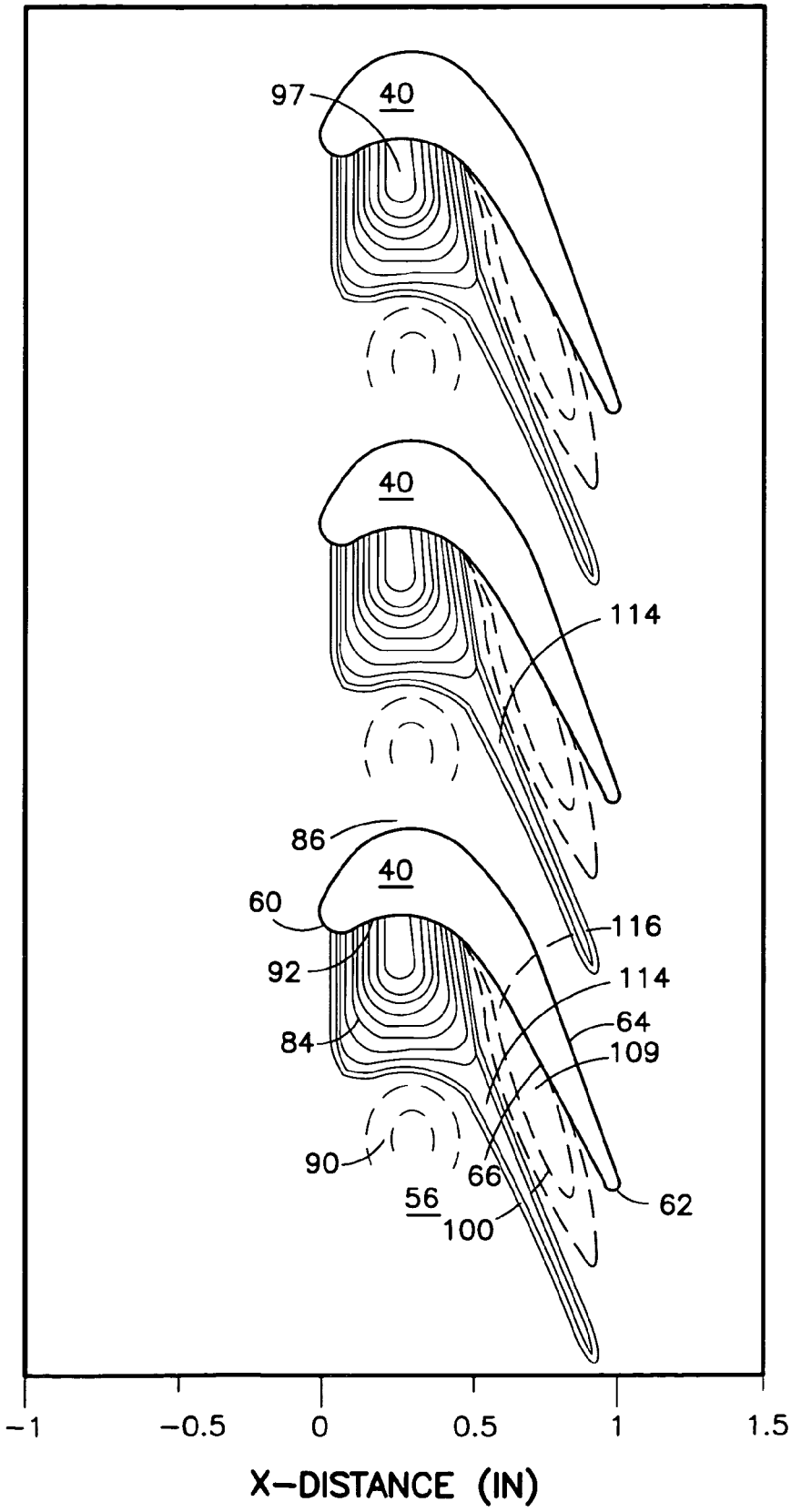

Referring to FIGS. 9 and 9A, analysis indicates that the aerodynamic performance of an airfoil array with a hump 84, a trough 100 or both can be further enhanced by the presence of a cross-passage ridge 114. Considering the case where the hump 84 is present (irrespective of whether the trough is present or absent) the ridge extends aftwardly from the hump and laterally across the passage toward the trailing edge 62 of the neighboring airfoil in the array. The ridge blends into a less elevated endwall profile part way across the passage and no further aft than about 100% of the axial chord. The less elevated profile is preferably substantially axisymmetric. The ridge may have a distinct peak whose height is less than the height of peak 97 or may merely decline in height with increasing distance away from the hump. In the case where the trough 100 is present but the hump 84 is absent, the ridge extends axially aftwardly from adjacent a forward portion 116 of the trough and laterally across the passage toward the trailing edge 62 of the neighboring airfoil in the array. The ridge blends into a less elevated profile part way across the passage and no further aft than about 100% of the axial chord. The less elevated profile is preferably substantially axisymmetric.

Although FIGS. 6 through 9A show only a single endwall, such as a radially inner endwall, the disclosed endwall geometries can be used at the radially opposing endwall or at both endwalls if an opposing endwall is present. In particular, the airfoil array may comprise two spanwisely separated endwalls with airfoils extending spanwisely between the endwalls to define a vane array. Or the array may comprise two spanwisely separated endwalls with the airfoils extending spanwisely between the endwalls to define a blade array. Or the array may comprise a single endwall with the airfoils extending spanwisely from the endwall to define a blade array.

Figure 10A:
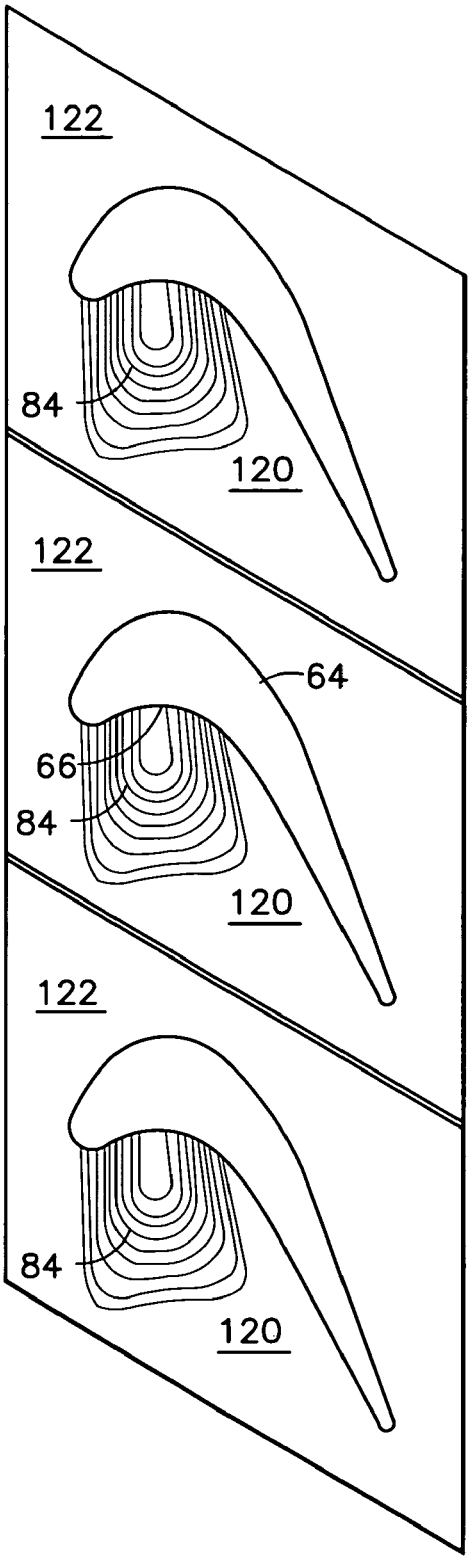
FIG. 10A is a plan view with topographic contours showing a portion of an airfoil array comprised of multiple blades or vanes and also showing a protrusion or hump residing entirely on a single platform.
Figure 10B:
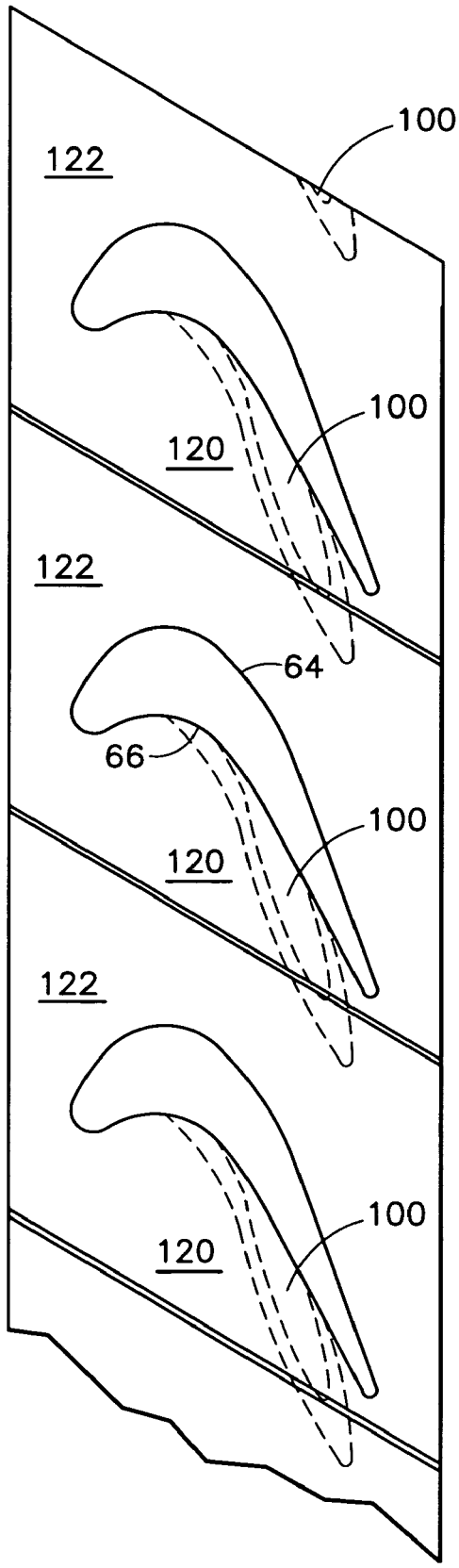
FIG. 10B is a plan view with topographic contours showing a portion of an airfoil array comprised of multiple blades or vanes and also showing a depression or trough partly on one platform and partly on an adjacent platform.

The foregoing illustrations show a circumferentially continuous endwall. However the disclosed geometries are also applicable to blades and vanes each having its own platform adapted to cooperate with platforms of other blades and vanes in the array to define and endwall. For example, FIGS. 10A and 10B show vanes or blades including an airfoil and a platform comprised of a pressure surface platform 120 extending laterally away from the airfoil pressure surface 66 and a suction surface platform 122 extending laterally away from the airfoil suction surface 64. When the vanes or blades are installed in an engine, the pressure surface platform of each vane or blade abuts or nearly abuts the suction surface platform of a neighboring vane or blade in the array to define a portion of an endwall. The nonaxisymmetric portion of the endwall, e.g. the hump 84 or trough 100, may reside entirely on the pressure surface platform as is the case with the hump 84 of FIG. 10A, or may be partially present on the pressure surface platform of one vane or blade and the suction surface platform of the neighboring vane or blade as is the case with the trough 100 of FIG. 10B.

Figure 11:
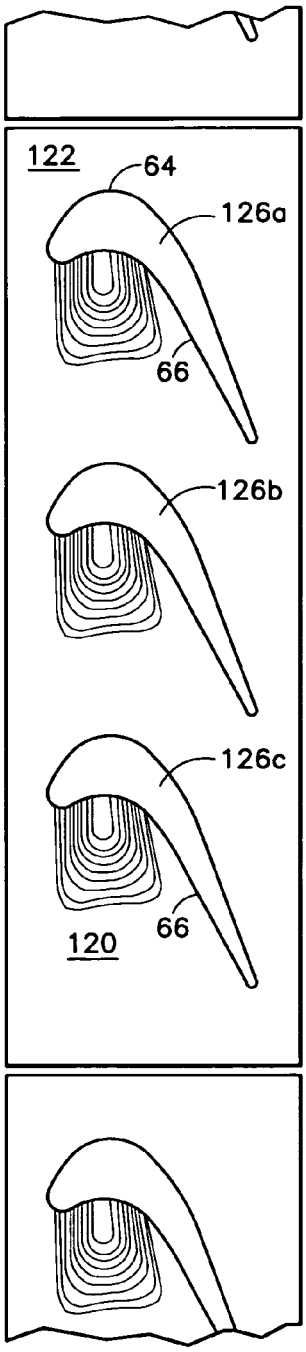
FIG. 11 is a plan view with topographic contours showing a portion of an airfoil array comprised of multiple blade or vane clusters and also showing a hump on the endwall.

The invention is also applicable to vane and blade clusters having at least two airfoils and a platform adapted to cooperate with platforms of other blade and vane clusters in the array to define an endwall. For example, FIG. 11 shows a cluster with three airfoils 126*a*, 126*b* and 126*c*. Airfoils 126*a* and 126*c* are laterally external airfoils. A pressure surface platform 120 extends laterally away from the pressure surface 66 of laterally external airfoil 126*c*. A suction surface platform 122 extends laterally away from the suction surface 64 of laterally external airfoil 126*a*. When the clusters are installed in an engine, the pressure surface platform of each vane or blade cluster abuts or nearly abuts the suction surface platform of a neighboring vane or blade cluster in the array to locally define an endwall. The nonaxisymmetric portion of the endwall, e.g. the hump 84 or trough 100, may reside entirely on the pressure surface platform as seen in FIG. 11, or it may be partially present on the pressure surface platform of one vane or blade and the suction surface platform of the neighboring vane or blade.

Figure 12:
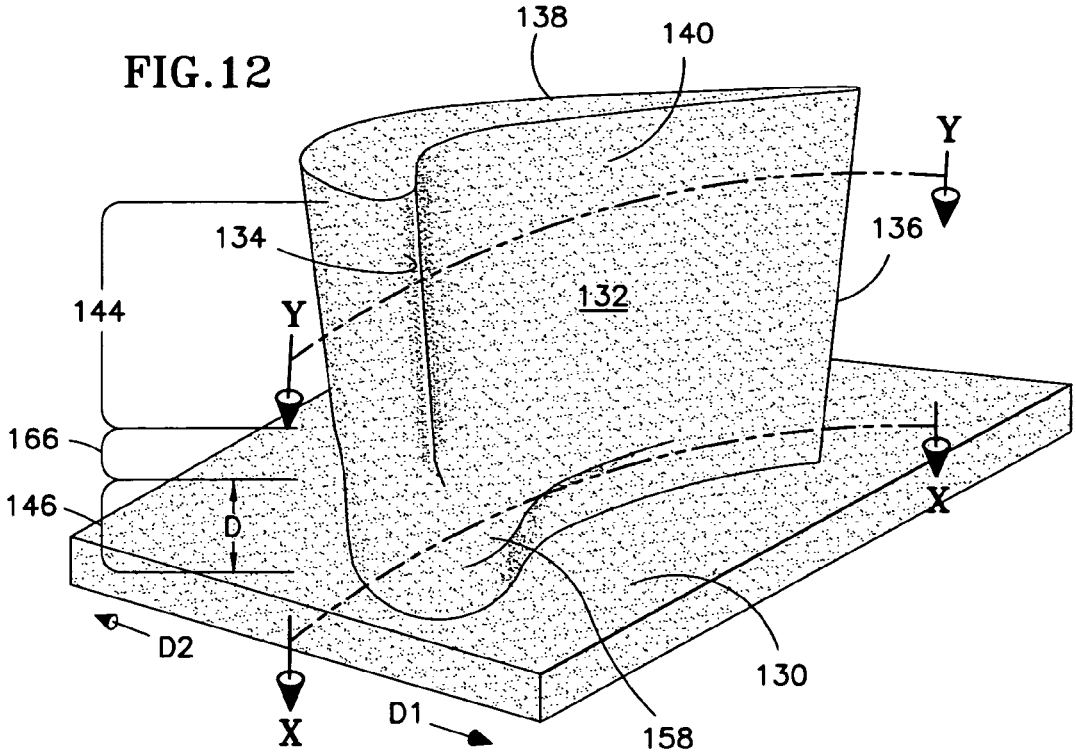
FIG. 12 is a perspective view of a blade or vane with an enlarged base.
Figure 12A:
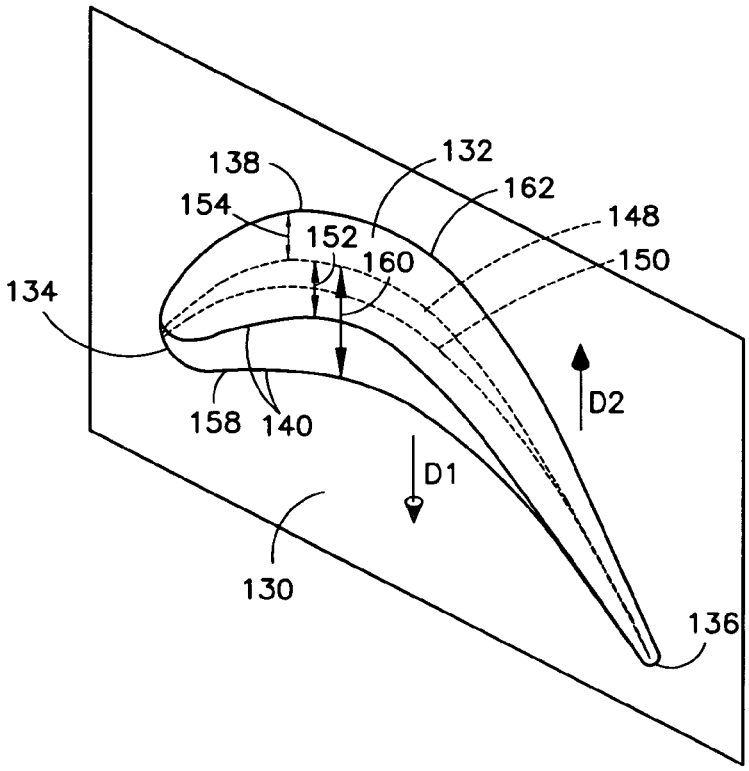
FIG. 12A is a plan view overlaying the sections X-X and Y-Y of FIG. 12.

FIGS. 12 and 12A show a blade or vane for mitigating secondary flow losses. The blade or vane includes a platform 130 and an airfoil 132 extending from the platform. The airfoil has a leading edge 134, a trailing edge 136, a suction surface 138 and a pressure surface 140. The airfoil also includes a part span portion 144 with a part span or reference mean camber line 148 and a base 146 with a base or offset mean camber line 150. The base is laterally enlarged in a first direction D1, specifically the direction directed away from the part span mean camber line toward the pressure surface 140 as shown in the illustration. The laterally enlarged base extends spanwisely a prescribed distance D from the platform. The prescribed distance is up to about 40% of the airfoil span. Along the part span portion 144, the pressure surface 140 is offset in the first direction D1 from the part span mean camber line 148 by a chordwisely varying pressure surface offset distance 152 and the suction surface 138 is offset in a second direction, laterally opposite direction D2 from the part span mean camber line 148 by a chordwisely varying suction surface offset distance 154. The base 146 includes a base pressure surface 158 offset from the part span mean camber line in the first direction D1 by a base offset distance 160 greater than the pressure surface offset distance 152 and also includes a base suction surface 162 offset from the part span mean camber line by an amount substantially the same as the suction surface offset distance 154.

Figure 13:
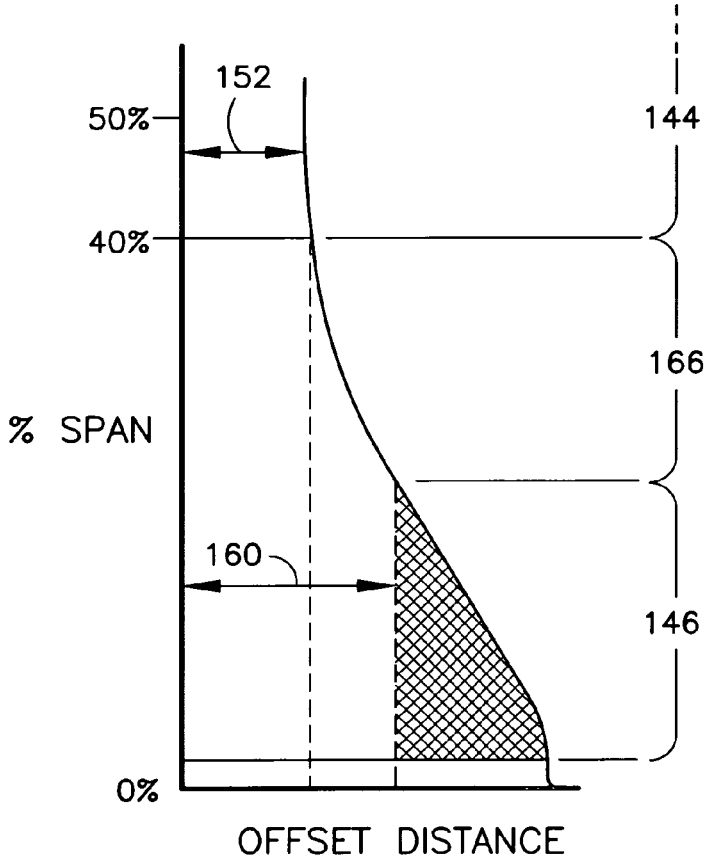
FIG. 13 is a graph showing offset distances of FIG. 12A.

The maximum value of the pressure surface offset distance 152 occurs between the leading and trailing edges and is approximately constant in the spanwise direction in the part span portion of the airfoil. The maximum value of the base offset distance 160 also occurs between the leading and trailing edges. As seen in FIG. 13, a blend region 166 connects the part span region 144 with the base region 146. The maximum value of the base offset distance 160 is at least about 140% of the maximum value of the pressure surface offset distance 152.

Alternatively, the blade or vane may be described as having a nonenlarged portion 144 with a reference mean camber line 148 and a laterally enlarged base 146 extending spanwisely a prescribed distance from the platform and having an offset mean camber line 150. The offset mean camber line is offset from the reference mean camber line in the direction D1.

Although FIGS. 12 and 12A show an enlarged base at only one spanwise extremity of the airfoil, such as near a radially inner platform or endwall, the enlarged base can be used near an endwall at the other extremity. The enlarged base may also be used at both extremities so that the blade or vane comprises two spanwisely spaced apart platforms, a first laterally enlarged base extending spanwisely a first prescribed distance from one of the platforms and a second laterally enlarged base extending spanwisely a second prescribed distance from the other of the platforms.

FIGS. 12 and 12A show a circumferentially continuous endwall such as those used integrally bladed rotors. However the enlarged base may be applied to vanes and blades comprising a platform and a single airfoil or may be applied to blade or vane clusters in the form of an integral unit comprising at least two airfoils. Either way, a turbine engine would include a blade or vane array comprising at least two blades or vanes or two blade or vane clusters.

The enlarged base affects the fluid dynamics in much the same way as the hump 84 of FIGS. 6 and 6A, i.e. it locally accelerates a portion of the boundary layer thereby encouraging the fluid to hug the pressure surfaces of the airfoils rather than becoming entrained in the horseshoe vortex 50.

The enlarged base 146 is believed to be most beneficial when applied to embedded airfoils, such as those used in second and subsequent stage vane arrays and in first and subsequent blade arrays.

Although this disclosure refers to specific embodiments of the endwall it will be understood by those skilled in the art that various changes in form and detail may be made without departing from the subject matter set forth in the accompanying claims.

We claim:

1. An airfoil array comprising a laterally extending endwall with a series of airfoils projecting therefrom, each airfoil having a suction surface corresponding to an airfoil suction side and a pressure surface corresponding to an airfoil pressure side;

the airfoils cooperating with the endwall to define a series of fluid flow passages, the suction surface of a first airfoil defining a suction side of a first fluid flow passage, the pressure surface of a second airfoil defining a pressure side of the first fluid flow passage; and wherein the endwall has a pressure side hump that blends into a less elevated endwall profile with increasing lateral displacement toward the suction side of the first fluid flow passage, the less elevated profile being noncomplementary with respect to the hump, said hump having at least a portion extending from the pressure side of the second airfoil, the hump having a concave downward profile, and the hump being wholly disposed on the pressure side of the second airfoil.

2. The array of claim 1 wherein the less elevated profile is axisymmetric.

3. The array of claim 1 wherein the less elevated profile includes a depression.

4. The array of claim 1 wherein each airfoil has a leading edge, a trailing edge and an axial chord, each passage has a local passage width, and the hump has a peak residing within a footprint whose axial range is from about −10% to about 50% of the axial chord and whose lateral range is from about the pressure surface to about 60% of the local passage width.

5. The array of claim 1 wherein each airfoil has an axial chord and the hump has a peak height of between about 3% and about 20% of the axial chord.

6. The array of claim 1 wherein the hump is located near a cove region of the airfoil.

7. The array of claim 1 wherein the airfoils are embedded airfoils for a turbine engine.

8. The array of claim 1 comprising a single endwall and wherein the airfoils extend spanwisely from the endwall to define a blade array.

9. The array of claim 1 comprising a pressure side trough essentially aft of the hump, the trough blending into a suction side endwall profile elevated and noncomplementary with respect to the trough.

10. The array of claim 1 wherein each airfoil has a trailing edge and the endwall includes a ridge extending axially aftwardly from the hump and laterally across the passage toward the trailing edge of a neighboring airfoil in the array.

11. The array of claim 10 wherein each airfoil has an axial chord and the ridge blends into a less elevated endwall profile part way across the passage and no further forward than about 100% of the axial chord.

12. The array of claim 11 wherein the less elevated endwall profile is axisymmetric.

13. The array of claim 10 wherein the hump has a peak hump height and the ridge has a peak ridge height less than the peak hump height.

14. The array of claim 9 wherein each airfoil has a trailing edge and the endwall includes a ridge extending axially aftwardly from the hump and laterally across the passage toward the trailing edge of a neighboring airfoil in the array.

15. The array of claim 14 wherein each airfoil has an axial chord and the ridge blends into a less elevated endwall profile part way across the passage and no further forward than about 100% of the axial chord.

16. The array of claim 14 wherein the hump has a peak hump height and the ridge has a peak ridge height less than the peak hump height.

17. The array of claim 16 wherein the less elevated endwall profile is axisymmetric.

18. A turbine component comprising:

a laterally extending endwall having at least one airfoil, said at least one airfoil having a suction surface and a pressure surface, the pressure surface corresponding to an airfoil pressure side, the at least one airfoil cooperating with the endwall to define a portion of fluid flow passages on each of said suction surface and said pressure surface, the endwall having a pressure side hump that blends into a less elevated endwall profile with increasing lateral displacement away from said pressure surface, the less elevated profile being noncomplementary with respect to the hump, said hump having at least a portion extending from the pressure surface, the hump having a concave downward profile, and the hump being wholly disposed on the pressure side of the at least one airfoil.

19. The array of claim 1, wherein said airfoil array has a generally equal elevated surface at locations spaced toward a trailing edge from the hump, and extending toward a suction side of the passage.

20. The array of claim 1, wherein said hump is entirely received within an axial chord of the airfoil.

21. The component of claim 18 wherein a pressure surface platform extends laterally away from the pressure surface of the airfoil and the hump resides entirely on the pressure surface platform.

22. The component as set forth in claim 18, wherein the at least one airfoil is a single airfoil.

23. The component as set forth in claim 18, wherein the at least one airfoil is part of a cluster, and there being at least two airfoils, and a platform adapted to cooperate with platforms of other clusters to define an endwall.

24. The component as set forth in claim 18, wherein the at least one airfoil is part of a vane.

25. The component as set forth in claim 18, wherein the at least one airfoil is part of a turbine blade.

26. The array of claim 1 wherein the hump is wholly disposed within the first fluid flow passage.

27. The array of claim 1 wherein the first fluid flow passage includes no more than one hump.

28. The array of claim 1 wherein the hump is displaced from the suction side of the second airfoil.

29. The component of claim 18 wherein no more than one hump extends from the at least one airfoil.

30. The array of claim 1 wherein the decrease in passage cross sectional area attributable to the hump does not equal the increase in passage cross sectional area attributable to the less elevated profile.

* * * * *